US010308337B1

(12) United States Patent
Liveoak

(10) Patent No.: US 10,308,337 B1
(45) Date of Patent: Jun. 4, 2019

(54) KAYAK FIN PADDLE

(71) Applicant: Tal Liveoak, Madison, AL (US)

(72) Inventor: Tal Liveoak, Madison, AL (US)

( * ) Notice: Subject to any disclaimer, the term of this patent is extended or adjusted under 35 U.S.C. 154(b) by 0 days.

(21) Appl. No.: 16/124,483

(22) Filed: Sep. 7, 2018

(51) Int. Cl.
*B63H 16/04* (2006.01)

(52) U.S. Cl.
CPC ..... *B63H 16/04* (2013.01)

(58) Field of Classification Search
CPC ..... B63H 16/04
See application file for complete search history.

(56) References Cited

U.S. PATENT DOCUMENTS 3,039,120 A * 6/1962 Powell ..... A01K 97/00 416/63
4,233,925 A * 11/1980 Proctor ..... B63H 16/04 416/70 R
4,493,663 A * 1/1985 Richmond ..... B63H 16/04 416/63
4,820,216 A * 4/1989 Masters ..... B63H 16/04 416/70 R
4,888,846 A * 12/1989 Natale ..... A47L 13/022 15/236.01
5,062,816 A * 11/1991 Berglund ..... A01K 77/00 416/74
5,795,201 A * 8/1998 Tibbetts ..... B63H 16/04 416/63
5,820,424 A * 10/1998 Steinhour ..... B63H 16/04 440/101
5,832,563 A * 11/1998 Simpson ..... A63B 71/0009 16/110.1
5,851,132 A * 12/1998 Merrill ..... B63H 16/04 440/101
6,022,255 A * 2/2000 Lukanovich ..... B63H 16/04 440/101
6,328,617 B1 * 12/2001 Gunnell ..... B63H 16/04 416/70 R
7,311,573 B1 * 12/2007 Dillenschneider ..... B63H 16/04 440/101
2005/0153606 A1 * 7/2005 Lane ..... B63H 16/04 440/101
2010/0124859 A1 * 5/2010 Bucknell ..... B63H 16/04 440/101

* cited by examiner

*Primary Examiner* — S. Joseph Morano
*Assistant Examiner* — Jovon E Hayes
(74) *Attorney, Agent, or Firm* — Cynthia R. Wright

(57) ABSTRACT

The device herein comprises a kayak or canoe paddle that allows a user to insert his or her arm and forearm through openings formed within the paddle while he or she grips the paddle. The insertion of the arm and forearm within the paddle allows the user's arm and forearm to provide additional support to the paddle. Additionally, the handle used to grip the paddle is formed perpendicular to the length of the paddle allowing a user to maintain his or her grip on the handle even if the kayak or canoe overturns. Two paddles may be joined together to form a single paddle with either a "V" shape or a linear shape. The "V" shaped paddle enhances the ability of the kayaker to traverse a body of water.

7 Claims, 12 Drawing Sheets

KAYAK FIN PADDLE

CROSS-REFERENCE TO RELATED APPLICATIONS

This application does not claim priority to any patent application.

DISCLOSURE REGARDING PRIOR DISCLOSURES BY THE INVENTOR OR A JOINT INVENTOR

The inventor has not disclosed this invention prior to the filing of this non provisional application.

BACKGROUND OF THE INVENTION (1) Field of the Invention

This device is an improved paddle for a kayak or a canoe. The device allows a user to insert his arm through each paddle so that they will have better control over the paddles while kayaking or canoeing. Also, the paddles have openings or holes that allow two separate paddles to be reversibly connected together to form a single paddle for kayak or canoeing. The paddles may be connected so that the blade of each paddle is set at an angle to the other blade, which improves stroke efficiency while paddling.

(2) Disclosure of the Prior Art

A number of kayak paddle devices are known in the prior art. Most of these prior art devices disclose paddles wherein a user grips the shaft of the paddle wherein the handle is formed along the length of the shaft. For example Gunnell (U.S. Pat. No. 6,328,716 B1) and Masters (U.S. Pat. No. 4,820,216) both disclose kayak paddles that include one or more grips that are formed along the length of the shaft and run parallel to the shaft. Both of these paddles allow the blades to rotate relative to a user and to each other while being gripped by a user along the shaft. These paddles allow uncontrolled rotation about the shaft so that it can be difficult for a user to control the angle the blades contact a body of water. Although both Gunnell and Masters allow the paddle blades to be rotated about the shaft so that the angle of blade contact with the water may be adjusted, a user of these devices is unable to effectively control the blade angle during row overs or turbulent water. A device that allows a user to better control rotation of the blades is needed.

Merrill (U.S. Pat. No. 5,851,132) discloses a kayak paddle with handles affixed perpendicular to the shaft or shafts wherein the handles rotate about an axis as the paddle is used to reduce twisting of the writs and other joints of the kayaker. Any rotation about the handle of a paddle shaft may make it difficult for a user to prevent unwanted rotation, and may slow the speed of a kayak due to unwanted rotation. But, a kayaker may not want the handle(s) to rotate about an axis during use. For example, a kayaker may injure his or her wrists while paddle upon a body of water during a storm or a strong current because of uncontrolled rotation of the wrists about the handle axis.

BRIEF SUMMARY OF THE INVENTION

This device comprises a fin-shaped paddle that may be used to kayak or canoe. The device comprises a blade body that is attached to a shaft, wherein the shaft forms a opening, and a handle or grip is included within the shaft opening so that the handle runs perpendicular to the upper and lower lengths of the shaft. A user easily grips the handle and manipulates the blade of the paddle by gripping the handle. A user's arm fits within the shaft opening allowing a user to support and control the blade via gripping the handle. The blade body is opposite a connecting body that allows two fin-shaped paddles to be coupled together. The connecting body allows the that runs the two paddles to be connected so that they are linear forming a straight paddle, or to be connected forming an angle so that the paddle has an upside down "V" shape. The linear combination of two paddles mocks the traditional kayak paddle shape, while the upside down "V" shape allows a user to adapt a shorter stroke while paddling, which provides greater control over the direction of movement of the kayak.

BRIEF DESCRIPTION OF THE DRAWINGS

The invention is described in detail below with reference to the appended drawings.

FIG. 1 depicts a top, exterior view of the device.

FIG. 2 depicts a side, exterior view of the device.

FIG. 3 depicts an angled, top view of the device.

FIG. 4 shows an top view of the device while being gripped by a user.

FIG. 5 illustrates a to view of two Kayak Fin Paddles being joined wherein the body of the two paddles is shown in a mid-sectional view.

FIG. 6 illustrates two Kayak Fin Paddles joined to form a single paddle.

FIG. 7 is a mid-sectional view of two Kayak Fin Paddles being joined depicting the section of each paddle that is being joined to the other paddle.

FIG. 8 is a mid sectional view of two Kayak Fin Paddles joined depicting the section of each paddle that has been physically joined to the other paddle.

FIG. 9 is a top, exterior view of an alternate embodiment with holes for joining two paddles together.

FIG. 10 depicts a side view of FIG. 9.

FIG. 11 illustrates a user holding the device depicted in FIG. 9 while kayaking.

FIG. 12 illustrates two paddles depicted in FIG. 9 joined together at an angle.

FIG. 13 illustrates two paddles depicted in FIG. 9 joined together at an angle.

FIG. 14 illustrates two paddles depicted in FIG. 9 joined linearly.

FIG. 15 shows a kayaker using the device of FIG. 4.

FIG. 16 depicts a kayaker using the device of FIG. 13.

FIG. 17 depicts a kayaker using the device of FIG. 14.

DETAILED DESCRIPTION OF THE INVENTION

Figure 1:
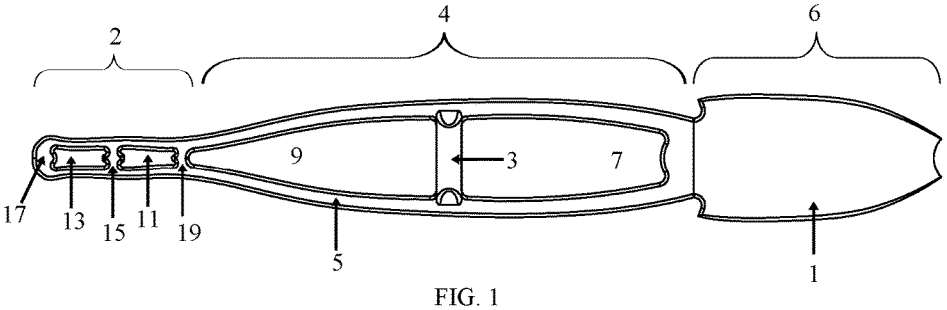
FIGS. 1 through 17 depict the Kayak Fin Paddle. In the Figures.

While this invention is susceptible of embodiment in many different forms, there are shown in the drawings and will herein be described in detail, several embodiments with the understanding that the present disclosure should be considered as an exemplification of the principles of the invention and is not intended to limit the invention to the embodiments so illustrated. Further, to the extent that any numerical values or other specifics of materials, etc., are provided herein, they are to be construed as exemplifications of the inventions herein, and the inventions are not to be considered as limited thereto.

The following description and drawings are illustrative and are not to be construed as limiting. Numerous specific details are described to provide a thorough understanding of the disclosure. However, in certain instances, well-known or conventional details are not described in order to avoid obscuring the description. References to one, or an embodiment in the present disclosure, can be, but not necessarily, references to the same embodiment; and, such references mean at least one of the embodiments.

Reference in this specification to "one embodiment' or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments, but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that the same term can be said in more than one way.

Consequently, alternative language and synonyms may be used for any one or more of the terms discussed herein, or is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including definitions will control.

Figure 2:
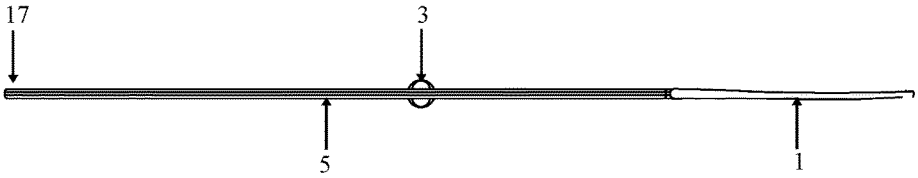

FIG. 1 depicts a top, exterior view of the device. The Kayak Fin Paddle may be comprised of wood, fiberglass, aluminum, plastic or any other suitable material. The device should be composed of a material that allows the device to float upon the water. Connecting body 2 includes: end 17, opening 13, support 15, opening 11, and support 19. Shaft body 4 includes: shaft 5, opening 9, opening 7, and handle 3. Fin head 6 includes blade 1. Fin head 6 connects to connecting body 2 via shaft body 4. FIG. 2 depicts a side, exterior view of the device. Note that handle 3 may have a diameter that is larger than shaft 5. Blade 1 may be of any shape that enables a user to paddle through or upon a body of water. End 17 may be rounded to prevent damage to a kayak or canoe during use.

Figure 3:
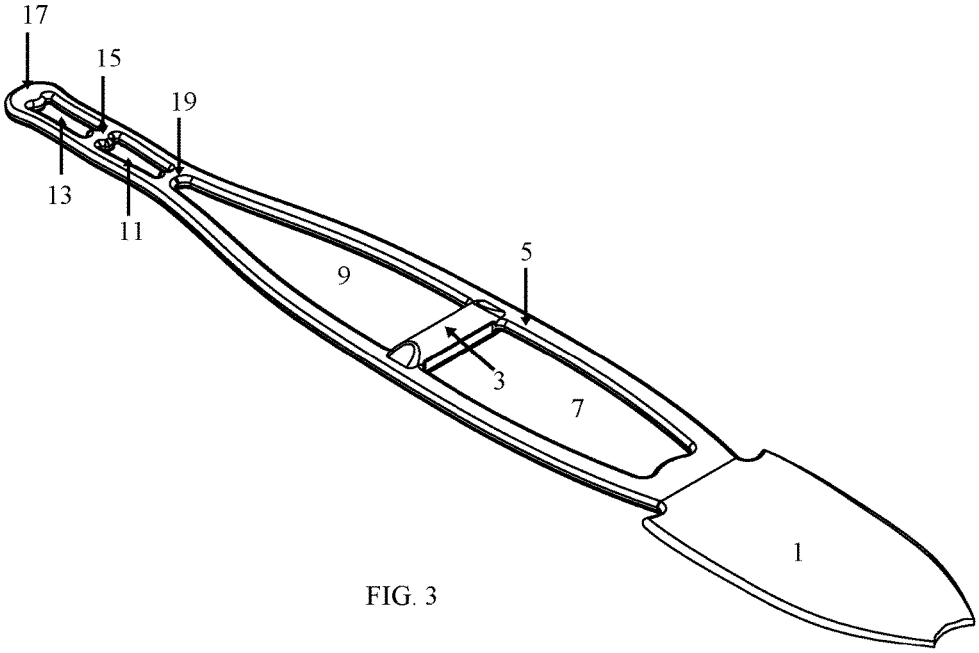

FIG. 3 illustrates an angled, top view of the device. Blade 1 connects to shaft 5. Shaft 5 includes opening 7 and opening 9, which are traversed by handle 3. Handle 3 may be composed of any suitable material and may have any shape or form which permits a user to easily, quickly, and comfortably grasp or grip it. Support 19, support 15, and end 17 form opening 11, and opening 13. Openings 11 and 13 allow two paddles to be connected to each other forming a single paddle.

Figure 4:
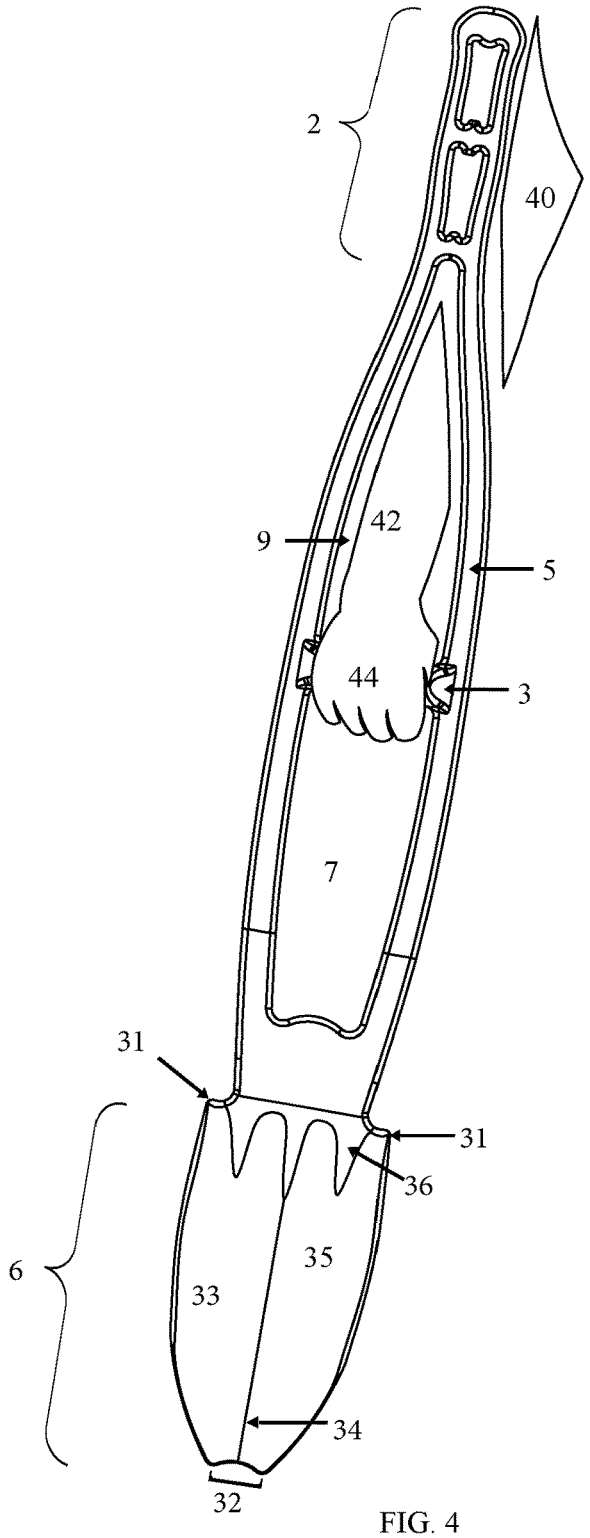

A user gripping the device is depicted in FIG. 4. Arm 40 is pressed against connecting body 2 allowing the user to manipulate the device by using his or her arm to press against connecting body 2. A user may move his arm 40 to move connecting body 20 to control the position of the device. The position of arm 40 against connecting body 2 allows the user to reinforce the positioning of the device to prevent unwanted movement of the paddle with rough current or waves. Forearm 42 may be inserted through opening 9 allowing hand 44 to traverse opening 7 to grip handle 3. The position of handle 3 aids a kayaker in up righting his upturned kayak because fin head 6 is in the correct orientation to recover when a user grips handle 3.

Fin head 6 may be shaped to resemble a fish fin. In FIG. 4, 6 is rounded in shape with lunate end 32 and fin barbs 31. Fin barbs 31 allows fin head to exude water from its surface during each paddle stroke. Fin side 33 and fin side 35 are formed so the thickness of fin head 6 increases as fin side 33 and fin side 35 approach fin midline 34. Fin barbs 31 allow user to grab a rope or string as needed, which is especially useful when pulling closer to a dock. Deformation 36 is formed to increase the thickness of fin head 6 from shaft 5 to midline 34. The overall shape of fin head 6 mimics a rounded fish fin allowing the device to move more easily and rapidly cut through water during use.

Figure 5:
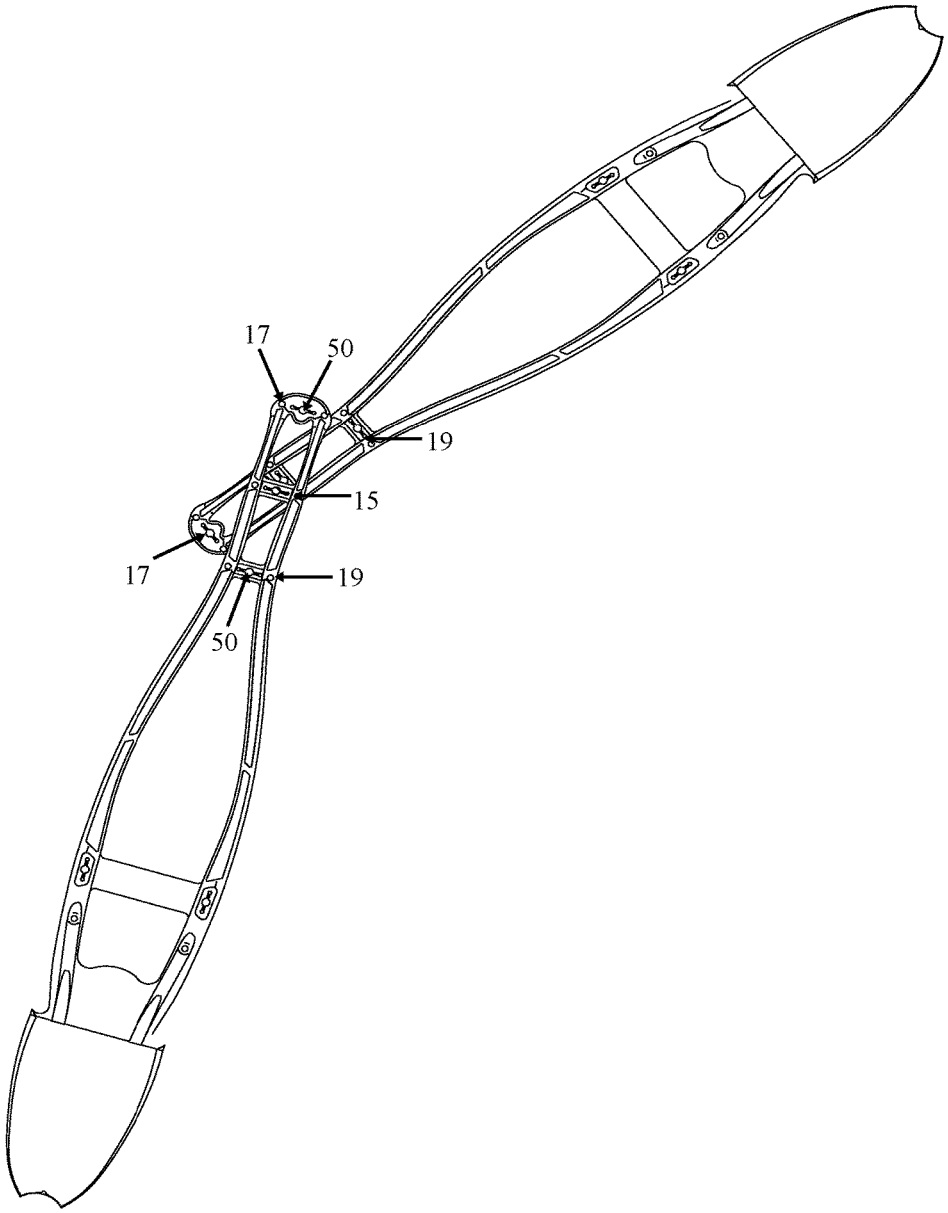

A mid-sectional vie of two paddles in the process of being joined to form a single paddle is illustrated in FIG. 5. Each paddle may be formed from two matching halves that are joined together. Hook and loop attachments, rope, bolts, or another means of securing the two paddles together may be positioned within the holes 50, which are formed in end 17, support 15, and support 19 of the other paddle. Note that support 19 of each paddle is not utilized to secure the two paddles together In this depiction. End 17 of the first paddle is secured onto support 15 of the second paddle, while end 17 of the second paddle is secured onto support 15 of the first paddle. Securing the paddles in this fashion ensures a tight bond between the two paddles.

Figure 6:
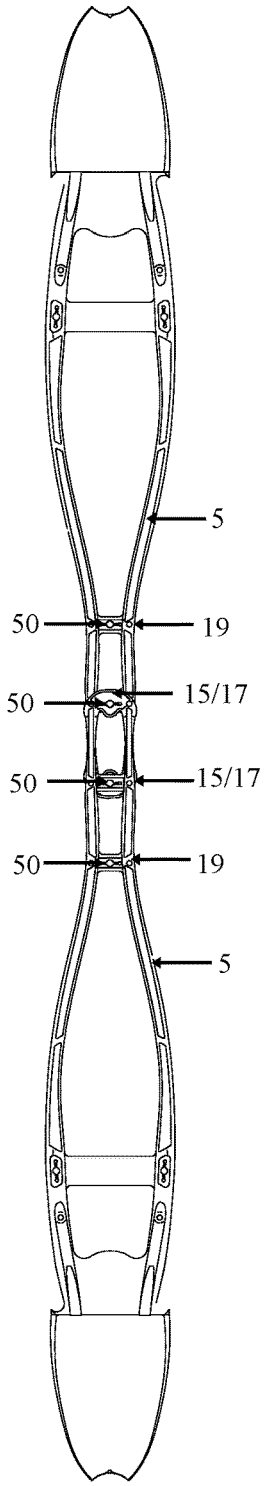
Figure 7:
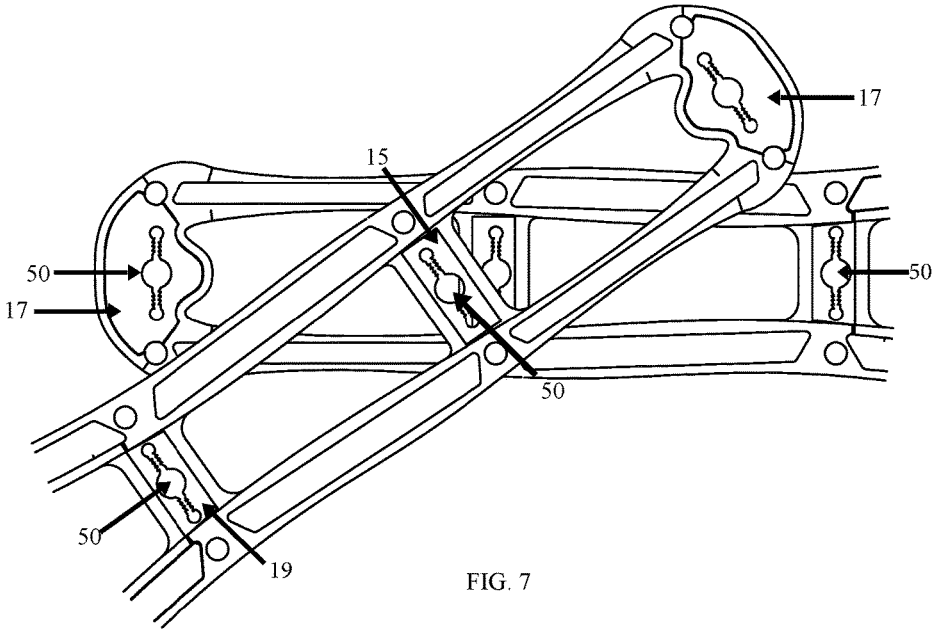
Figure 8:
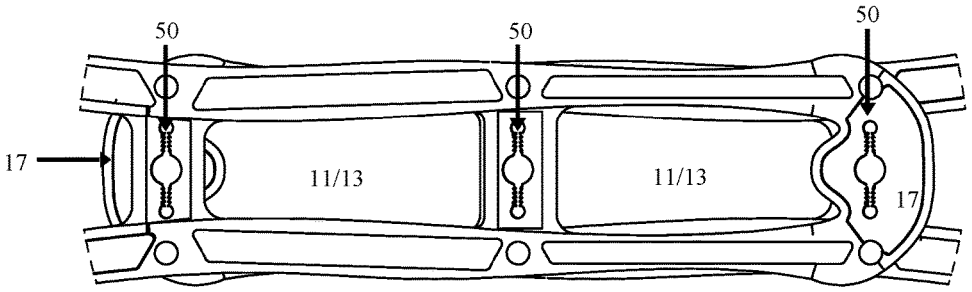

FIG. 7 is a blow up of the connecting bodies shown in FIG. 5, while FIG. 8 is a blow up of the connecting bodies shown in FIG. 6. FIG. 7 depicts hole 50 in end 17, hole 50 in support 15, and hole 50 in support 19. Each hole 50 may be used to secure two paddle together. FIG. 8 depicts hole 50 on end 17 aligned with a hole 50 on support 15. Note that opening 11 and opening 13 are the same openings when the two paddles are combined.

Figure 9:
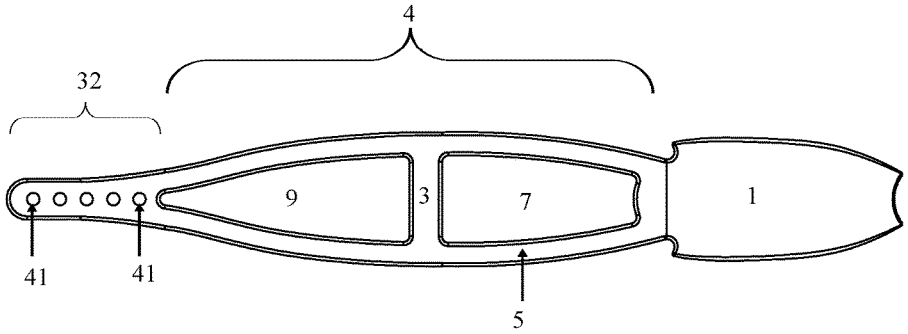
Figure 10:
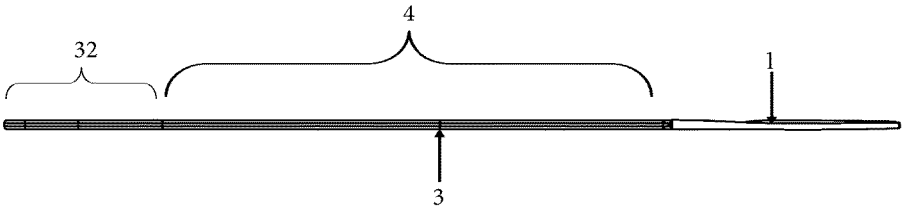

FIG. 9 illustrates a top, exterior view of an alternate embodiment wherein connecting body 32 includes connector openings 41 that may be utilized to secure two paddles together. Shaft body 4 includes: shaft 5, opening 9, opening 7, and handle 3. Blade 1 may be formed into the shape of a fish fin to facilitate quick, easy movement of the paddle in and out of a body of water. FIG. 10 depicts a side, exterior view of FIG. 9. Blade 1 connects to connecting body 32 via shaft body 4. Note handle 3 does not protrude above the plane of the paddle.

Figure 11:
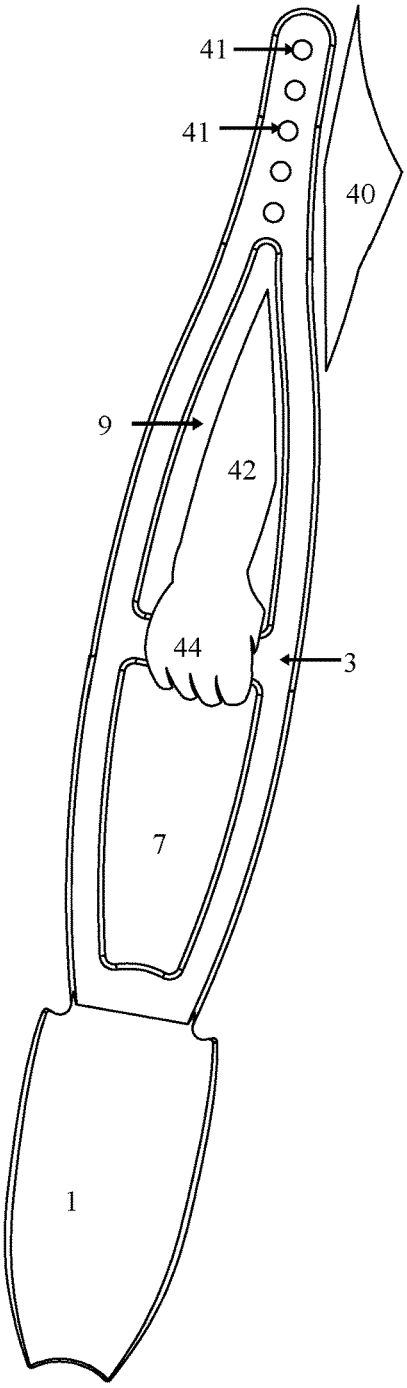

A user using the alternate embodiment depicted in FIG. 9 is illustrated in FIG. 11. Arm 40 anchors the paddle against the user. Forearm 42 is inserted through opening 9, hand 44 grips handle 3 through opening 7. Shaft 5 runs the length from blade 1 to the connector openings 41. One or more bolts, a length of rope, a length of string, etc. may be inserted into connector openings 41 on two separate paddles to secure them together. Handle 3 may be formed from shaft 5 as shown in FIG. 11.

Figure 12:
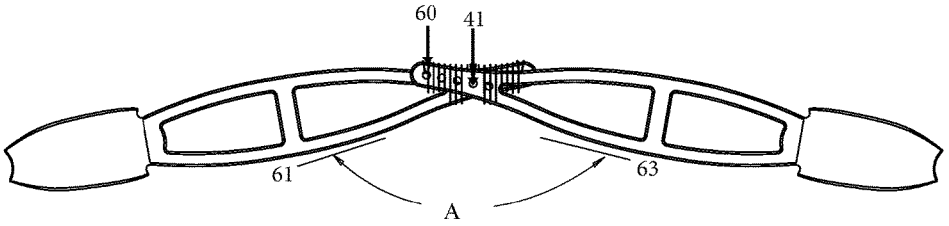

FIG. 12 illustrates two paddles joined via rope 60 that has been thread between one or more connector openings 41 on two separate paddles joining said paddles. Line 61 is a line drawn beneath a first paddle that runs along the bottom of said paddle. Line 63 is a line drawn beneath a second paddle that runs along the bottom of said second paddle. Angle A is the angle formed between line 61 and line 63 is less than 180°, and in this example is 160°. The 160° angle of the paddles allows a user to move the kayak deeper into the surface of the water than if the paddles were arranged in an 180° configuration, which allows a kayaker to go further with fewer strokes. Also, the 160° angle allows a user to have a shorter stroke, which makes the kayak, or canoe, move faster along the surface of the water.

Figure 13:
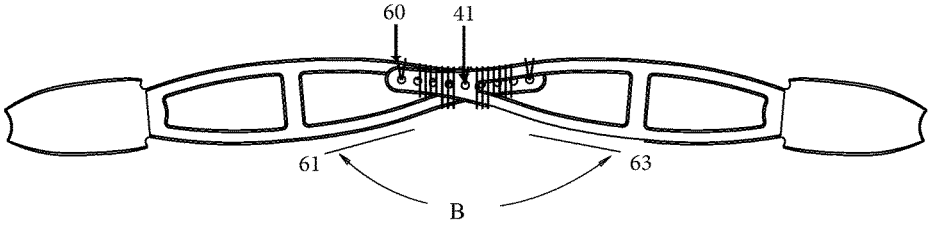

FIG. 13 illustrates two paddles joined via rope 60 that has been thread between two or more connector openings 41 on two separate paddles joining said paddles. Line 61 is a line drawn beneath a first paddle that runs along the bottom of said paddle. Line 63 is a line drawn beneath a second paddle that runs along the bottom of said second paddle. Angle B is the angle formed between line 61 and line 63 is 170° in FIG. 13. The 170° angle of the paddles allows a user to move the kayak deeper into the surface of the water than if using a 180° degree linear arrangement of paddles, which allows a kayaker to go further with fewer strokes. Also, the 160° angle allows a user to have a shorter stroke, which makes the kayak, or canoe, move faster along the surface of the water.

Figure 14:
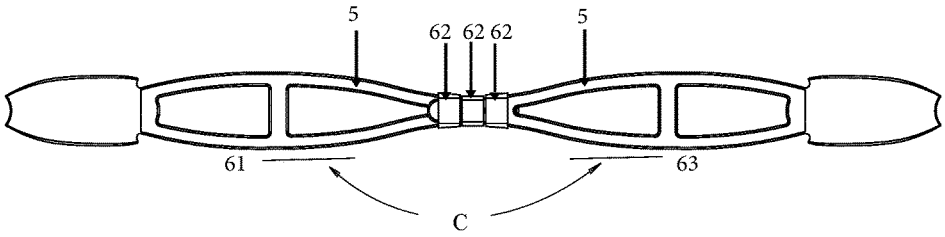

A linear configuration of two paddles depicted in FIG. 14. hook and loop attachment 62 is utilized to connect two paddles together. Line 61 is a line drawn beneath a first paddle that runs along the bottom of said paddle. Line 63 is a line beneath a second paddle that runs along the bottom of said second paddle. Angle C is the angle formed between line 61 and line 63. Angle C is 180 degrees in FIG. C. This 180-degree angle allows two paddles to be joined to form a single two-bladed kayak or canoe paddle.

Figure 15:
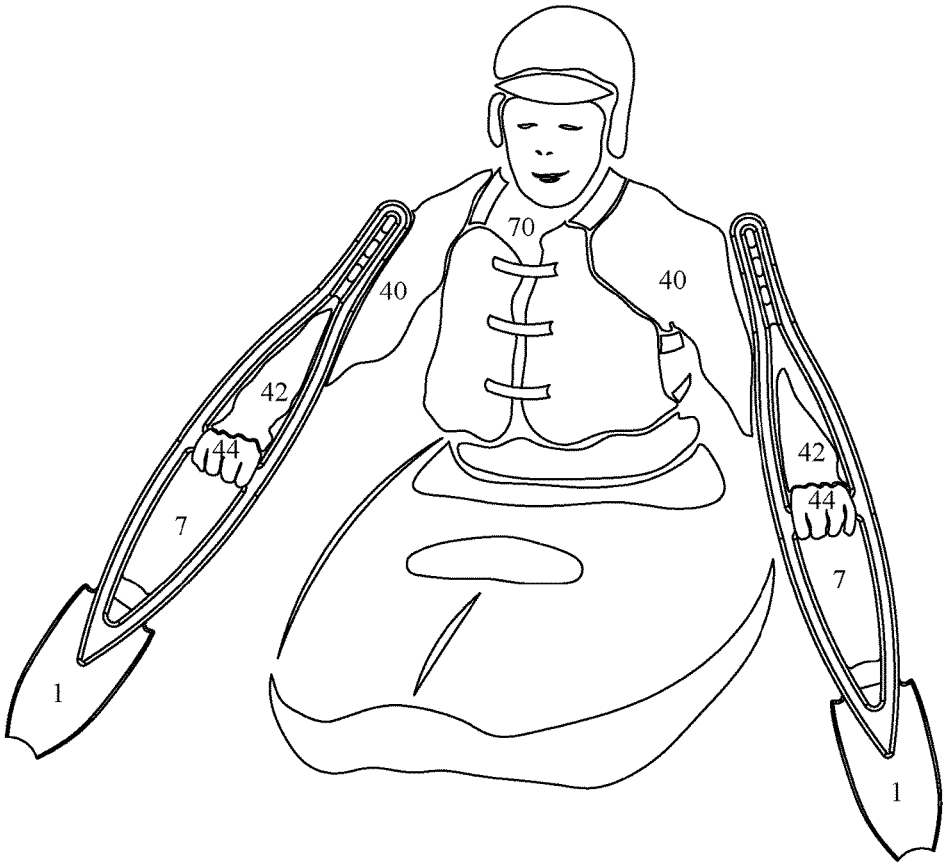

Kayaker 70 utilizing the device is depicted in FIG. 15. Note that kayaker 70 has both arms 40 aligned with end 17 of the paddle. Forearms 42 are inserted through the paddle with hands 44 gripping inserted through opening 7 and gripping the paddle. Blades 1 are inserted into the water, and kayaker 70 is paddling through the water. This embodiment allows kayaker 70 to paddle faster through the water than other paddles because this device allows kayaker 70 to modify the angle at which each paddle contacts the body of water he is paddling on. Additionally, this embodiment allows kayaker 70 to maintain paddle orientation so that he can quickly and easily recover if the kayak, or canoe, overturns during paddling. Kayaker 70 maintains paddle orientation via having his arms intertwined within the paddle and via having a grip that is perpendicular to the length of the paddle.

Figure 16:
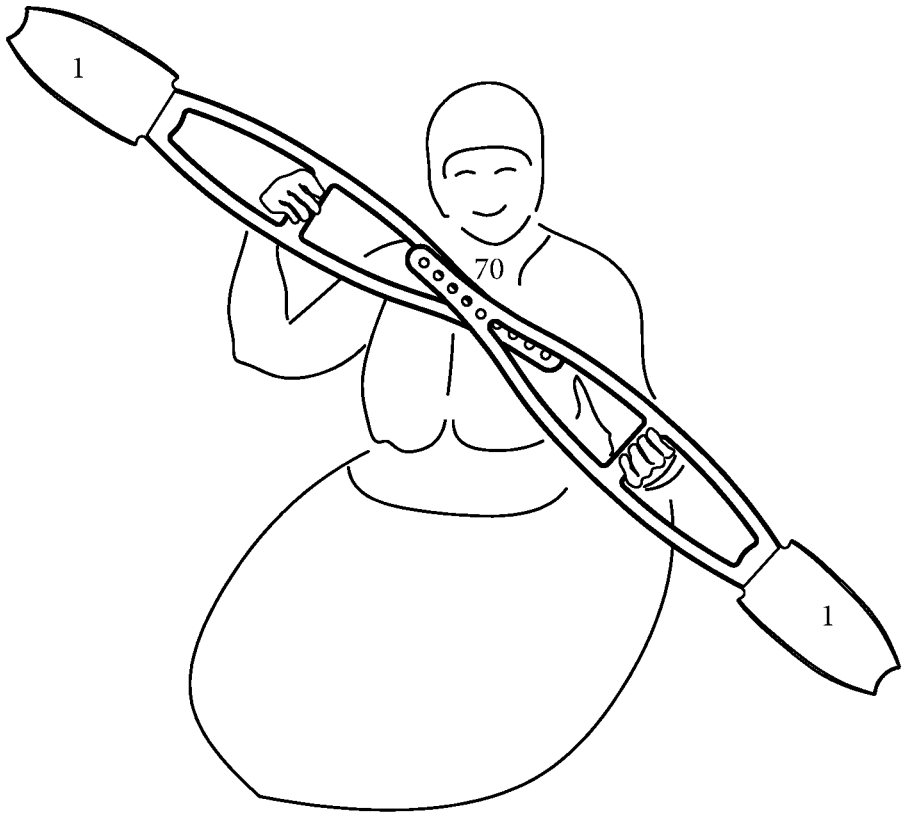
Figure 17:
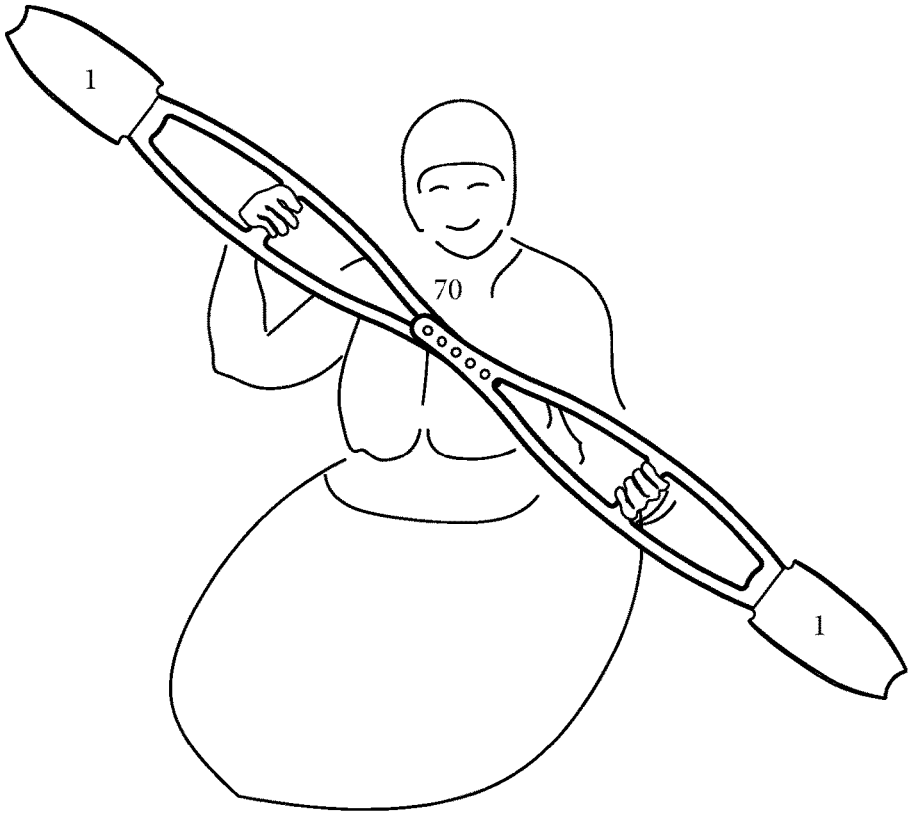

Kayaker 70 may use the paddles individually, as shown in FIG. 15, or may use two paddles joined together as shown in FIGS. 16 and 17. FIG. 16 depicts kayaker utilizing the paddle configuration depicted in FIG. 13. Note that rope 60 has been omitted from the depiction. Kayaker 70 is shown gripping both paddles without the kayaker's arm 40 being positioned within paddle opening 9. Kayaker 70 is able to move his kayak upon the water faster than in the prior art because the angle of blades 1 is less than 180° allowing him to move the blades 1 deeper into the water with less effort.

Kayaker 70 is shone in FIG. 17 utilizing the paddle configuration shown in FIG. 14. Note that hook and loop attachment 62 is not shown. This configuration mimics a traditional two-bladed paddle. Hook and loop attachment 62 may be added or removed by the kayaker 70 during a single kayaking excursion to allow kayaker 70 to quickly and easily switch between FIGS. 15, 16 and 17 at will.

The inventor hereby claims:

1. A kayak paddle compromising: A paddle blade; an end body lacking a paddle blade; a shaft connecting the paddle blade and the end body, wherein the shaft includes: a first opening for a kayaker to insert his or her forearm, a second opening for a kayaker to insert his or her hand, and a handle that separates the first and second openings, wherein the handle is perpendicular to the shaft; wherein the paddle blade includes two identical sides comprising: a lunate end, an end portion that connects the kayak paddle, wherein the end portion includes at least one protrusion for allowing a kayaker to grab a rope or string, and a midline running the length of the paddle blade wherein the midline has a greater thickness than the remaining portion of the paddle blade.

2. The device of claim 1 wherein the end body includes one or more end body openings for inserting a rope or string or hook and loop attachments.

3. A kayak paddle comprising: two kayak paddles that have been joined, wherein each of the two kayak paddles comprises a paddle blade with a lunate end, an end body, and a shaft connecting the end body to the paddle blade, and a midline running the length of the paddle blade wherein the midline has a greater thickness than the remaining portion of the paddle blade, wherein the end body includes one or more body openings, and wherein the two kayak paddles are joined by inserting rope, string or hook and loop attachments through the one or more body openings on the two kayak paddles.

4. The device of claim 3 wherein the kayak paddle comprises: one of said two kayak paddles joined to the other of said two kayak paddles at an angle of 180 degrees.

5. The device of claim 3 wherein the kayak paddle comprises: one of said two kayak paddles joined to the other of said two kayak paddles at an angle other than 180 degrees.

6. The device of claim 1 wherein the kayak paddle is a canoe paddle.

7. The device of claim 3 wherein the kayak paddle is a canoe paddle.

* * * * *